US010405663B2

(12) United States Patent
Yang

(10) Patent No.: US 10,405,663 B2
(45) Date of Patent: Sep. 10, 2019

(54) AIR INFLATION DEVICE FOR INFLATING AIR SUPPORT FURNITURE AND METHOD OF USING THE SAME

(71) Applicant: Zhejiang Hengfeng Top Leisure Co., Ltd., Wukang Town (CN)

(72) Inventor: Baoqing Yang, HangZhou (CN)

(73) Assignee: ZHEJIANG HENGFENG TOP LEISURE CO., LTD., Zhejiang (CN)

( * ) Notice: Subject to any disclaimer, the term of this patent is extended or adjusted under 35 U.S.C. 154(b) by 0 days.

(21) Appl. No.: 15/957,038

(22) Filed: Apr. 19, 2018

(65) Prior Publication Data

US 2018/0317657 A1 Nov. 8, 2018

Related U.S. Application Data

(60) Provisional application No. 62/501,528, filed on May 4, 2017.

(51) Int. Cl.
*A47C 4/54* (2006.01)
*A47C 3/16* (2006.01)

(52) U.S. Cl.
CPC . *A47C 4/54* (2013.01); *A47C 3/16* (2013.01)

(58) Field of Classification Search
CPC ..... A47C 4/54; A47C 3/16; A47C 27/081; A47C 27/084; A47G 9/1027; Y10T 137/3584; Y10T 137/7879; Y10T 137/7888
USPC ..... 5/655.3
See application file for complete search history.

(56) References Cited

U.S. PATENT DOCUMENTS

| | | | | | |
|---|---|---|---|---|---|
| 1,944,466 | A | * | 1/1934 | Rubin | A47C 27/081 5/708 |
| 2,942,281 | A | * | 6/1960 | Cole | A47C 27/128 5/644 |
| D214,623 | S | | 7/1969 | Williams | |
| 3,584,914 | A | | 6/1971 | Williams | |
| D226,153 | S | | 1/1973 | Boak | |
| 3,965,506 | A | | 6/1976 | Marks | |
| 4,011,611 | A | | 3/1977 | Lederman | |
| 4,557,377 | A | * | 12/1985 | Maloney | B65B 9/023 206/219 |
| 4,724,560 | A | * | 2/1988 | Christie | A47C 27/081 5/644 |
| 4,768,247 | A | * | 9/1988 | Beier | A47G 9/0253 5/490 |
| 5,033,742 | A | | 7/1991 | Johnson et al. | |
| 5,706,532 | A | | 1/1998 | Kettenhofen | |

(Continued)

OTHER PUBLICATIONS

"ChillaX Inflatable Lounger Hammock", amazon.com, Jun. 6, 2016, site visited Feb. 8, 2018, https://www.amazon.com/ChillaX-Inflatable-Lounger-Hammock-Travelling/dp/B01MCT5M6E/ref=cm_cr_arp_d_product_top?ie=UTF8.

(Continued)

*Primary Examiner* — Craig J Price
(74) *Attorney, Agent, or Firm* — Thompson Coburn LLP

(57) ABSTRACT

An air support article of air inflatable furniture comprises an air inflation device. The air inflation device provides an openable and closable opening into the sack that forms the majority of the article. The air inflation device comprises at least one pliable flap attached to the sack. The flap acts as a partial check valve that allows the article to be inflated simply by rapidly opening and closing the opening.

15 Claims, 9 Drawing Sheets

(56) References Cited

U.S. PATENT DOCUMENTS

| | | | | |
|---|---|---|---|---|
| 5,864,908 | A * | 2/1999 | Kielman | A47C 27/081 5/420 |
| 6,019,122 | A * | 2/2000 | Chen | F16K 15/202 137/223 |
| 6,212,716 | B1 * | 4/2001 | Logan, Jr. | A47G 9/1027 383/3 |
| D487,207 | S | 3/2004 | Manuel | |
| 6,934,989 | B2 * | 8/2005 | Ledvina | A47G 9/1027 137/238 |
| D601,793 | S | 10/2009 | Sartor | |
| 8,978,693 | B2 * | 3/2015 | Frayne | F16K 15/20 137/512 |
| D764,823 | S | 8/2016 | Oomen | |
| D775,479 | S | 1/2017 | Oomen | |
| D777,461 | S | 1/2017 | Hashemi | |
| D783,300 | S | 4/2017 | Pinholster, Jr. et al. | |
| D785,960 | S | 5/2017 | Davis et al. | |
| D804,208 | S | 12/2017 | Lam | |
| D819,993 | S | 6/2018 | Yang | |
| D819,994 | S | 6/2018 | Yang | |
| 10,058,182 | B2 * | 8/2018 | Zonneveld | A47C 20/02 |
| 2004/0064892 | A1 * | 4/2004 | Ledvina | A47G 9/1027 5/644 |
| 2004/0255379 | A1 * | 12/2004 | Zheng | A47C 4/54 5/413 AM |
| 2005/0061409 | A1 * | 3/2005 | Chung | A45C 7/0081 150/110 |
| 2006/0250000 | A1 | 11/2006 | Fischer et al. | |
| 2007/0080078 | A1 * | 4/2007 | Hansen | B65D 81/3266 206/219 |
| 2008/0121307 | A1 * | 5/2008 | Liao | B31D 5/0073 141/198 |
| 2015/0250328 | A1 * | 9/2015 | Brechet | A47C 27/086 297/452.41 |
| 2018/0000248 | A1 * | 1/2018 | Spector | A47C 7/021 |
| 2018/0044066 | A1 * | 2/2018 | Lee | A47C 27/081 |

OTHER PUBLICATIONS

"Inflatable Air Lounger Lounge Bag Chair", amazon.com, Feb. 13, 2017, site visited Feb. 8, 2018; https://www.amazon.com/Live-Infinitely-Inflatable-Features-Headrest/dp/B071CRND3B/ref=cm_cr_arp_d_product_top?ie=UTF8.

"US Lounger Fast Inflatable Portable", amazon.com, Feb. 20, 2017, site visited Feb. 8, 2018, https://www.amazon.com/ US-Lounger-Headrest-Inflatable-Portable/dp/B071VVTTSXQ/ref=cm_cr_arp_d_product_top?ie=UTF8.

"Yellow Layzee Lounger Inflatable Festival Camping Garden Beach Lay Bag/Bed/Sofa UK", Jun. 30, 2016, bedsack.co.uk, site visited Feb. 1, 2018, http://bedsack.co.uk/home/10-yellow-bedsack-inflatable-lounger.html.

* cited by examiner

AIR INFLATION DEVICE FOR INFLATING AIR SUPPORT FURNITURE AND METHOD OF USING THE SAME

CROSS-REFERENCE TO RELATED APPLICATIONS

This application is a non-provisional application of 62/501,528, which was filed on May 4, 2017, the disclosure of which is incorporated by reference herein.

BACKGROUND

The present invention pertains to devices for inflating collapsible air support furniture such as lounge chairs. More specifically, the present invention pertains to air inflation devices for rapidly inflating such inflatable furniture in the absence of appreciable wind.

Fairly recently collapsible air support furniture such as beach lounge chairs were invented that comprise large closeable inflation openings that allow users to rapidly inflate such furniture by simply holding the inflation opening open in the direction of a strong wind (such is common on beach front property). Although, in the absence of sufficient wind the user could also attempt to inflate such furniture by holding the inflation opening and swinging the opening back and forth frantically (much like one typically inflates trash bags), the size of the inflated furniture makes doing so extremely difficult, if at all possible. As a result most inflatable furniture designed to be filled without the use of mere wind speed, are often fitted with much smaller inflation openings configured to be manually blown into via one's mouth or some sort of mechanical pump.

In view of the foregoing, the following invention has been developed to work in conjunction with traditional wind filled inflatable furniture to allow such device to optionally be filled with air in the absence of wind without manually blowing into them by mouth or using some sort of mechanical pump.

SUMMARY OF THE INVENTION

The present invention pertains to flaps positioned internally in the inflatable furniture adjacent the large closeable inflation openings. The flaps act as flapper valves of sorts that allow the rapid open and closing of the inflation to pump air into the inflatable furniture in the absence of any other wind or blowing. The flaps do not however, prevent air from being released from the inflatable furniture when desired and therefore inflated furniture can still easily be released from the inflatable furniture when it is desired to collapse and fold such furniture for compact transportation or storage.

In one aspect of the invention, an air support article of air inflatable furniture comprises a sack having an air inflation device. The sack is formed of a pliable material and is configured and adapted to be adjusted between an inflated configuration and a deflated configuration. The sack is configured to at least partially support a human above a surface when the sack is in the inflated configuration. The sack is configured to be folded compactly upon itself when in the deflated configuration. The air inflation device provides an openable and closable opening into the sack and comprises first and second resiliently flexible elongate members and at least one pliable flap attached to the sack. The resiliently flexible elongate members each have opposite first and second axial ends. The first ends of the resiliently flexible elongate members are operatively connected to each other and the second ends of the resiliently flexible elongate members are operatively connected to each other. The resiliently flexible elongate members are configured and adapted such that they can be arced in opposite directions from each other in a manner such that the opening into the sack is in an open configuration. The resiliently flexible elongate members are also configured and adapted such that they can be adjacent each other, either circumjacent to each other or parallel to each other, in a manner such that the opening into the sack is in the closed configuration. The flap has opposite leading and trailing edges. The flap is internal to the sack and the leading edge of the flap is operatively attached at least adjacent to the first resiliently flexible elongate member. The trailing end of the flap is unattached to the sack and free to move within the sack. The air inflation device is configured such that, if the opening into the sack is adjusted from the closed configuration to the open configuration, the flap can partially prevent any air within the sack from exiting the sack rapidly through the opening, and such that, if the opening into the sack is adjusted from the open configuration to the closed configuration, the flap does not restrict air from entering rapidly into the sack past the trailing edge of the flap. The flap thereby serves as a partial, but not total, air check valve on air entering and exiting the sack.

Another aspect of the invention pertains to a method of inflating an air support article. The air support article of air inflatable furniture comprises a sack having an air inflation device. The sack is formed of a pliable material and configured and adapted to be adjusted between an inflated configuration and a deflated configuration. The sack is configured to at least partially support a human above a surface when the sack is in the inflated configuration. The sack is configured to be folded compactly upon itself when in the deflated configuration. The air inflation device provides an openable and closable opening into the sack and comprises first and second resiliently flexible elongate members and first and second pliable flaps attached to the sack. The resiliently flexible elongate members each have opposite first and second axial ends. The first ends of the resiliently flexible elongate members are operatively connected to each other and the second ends of the resiliently flexible elongate members are operatively connected to each other. The resiliently flexible elongate members are configured and adapted such that they can be arced in opposite directions from each other in a manner such that the opening into the sack is in an open configuration. The resiliently flexible elongate members are also configured and adapted such that they can be adjacent each other, either circumjacent to each other or parallel to each other, in a manner such that the opening into the sack is in the closed configuration. The first and second flaps each have opposite leading and trailing edges. The first and second flaps are internal to the sack. The leading edge of the first flap is operatively attached at least adjacent to the first resiliently flexible elongate member. The second flap is internal to the sack and the leading edge of the second flap is operatively attached at least adjacent to the second resiliently flexible elongate member. The trailing ends of the first and second flaps are unattached to the sack and are free to move within the sack. The air inflation device is configured such that, if the opening into the sack is adjusted from the closed configuration to the open configuration, the trailing edges of the first and second flaps move at least partially toward each other in a manner that can partially prevent any air within the sack from exiting the sack rapidly through the opening, and such that, if the opening into the sack is adjusted from the open configuration to the closed configuration, the trailing edges of the first and second flaps move away from each other in a manner that does not restrict air from entering rapidly into the sack beyond the trailing edges of the first and second flaps. The first and second flaps together thereby serve as a partial, but not total, air check valve on air entering and exiting the sack. The method of inflating the air support article comprises utilizing the air inflation device in a manner altering the opening back and forth from the open configuration to closed configuration.

Further features and advantages of the present invention, as well as the operation of the invention, are described in detail below with reference to the accompanying drawings.

Figure 1:
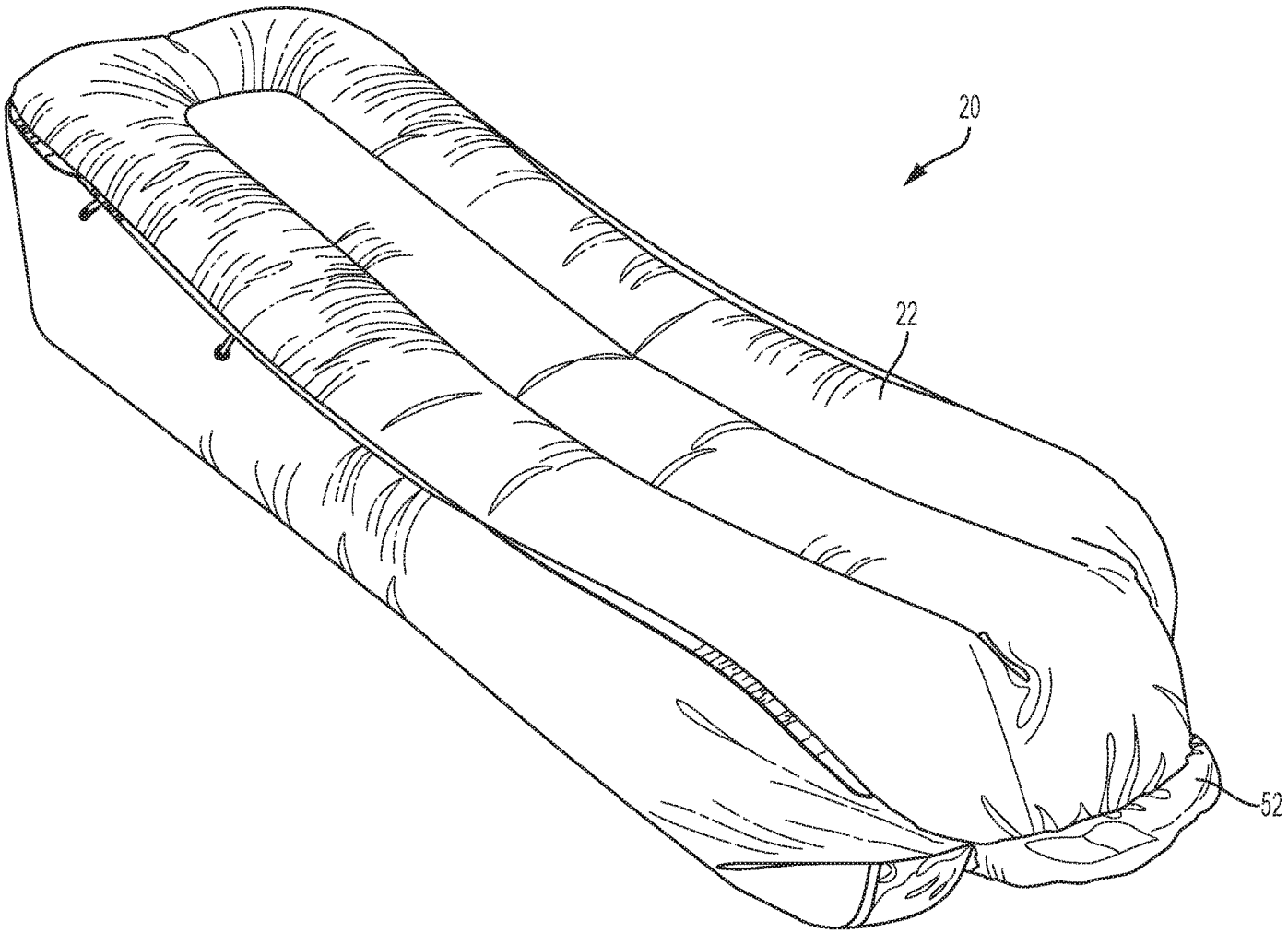
FIG. 1 is a perspective view of an article of air inflatable furniture in accordance with the invention in its inflated and ready for use configuration.
Figure 2:
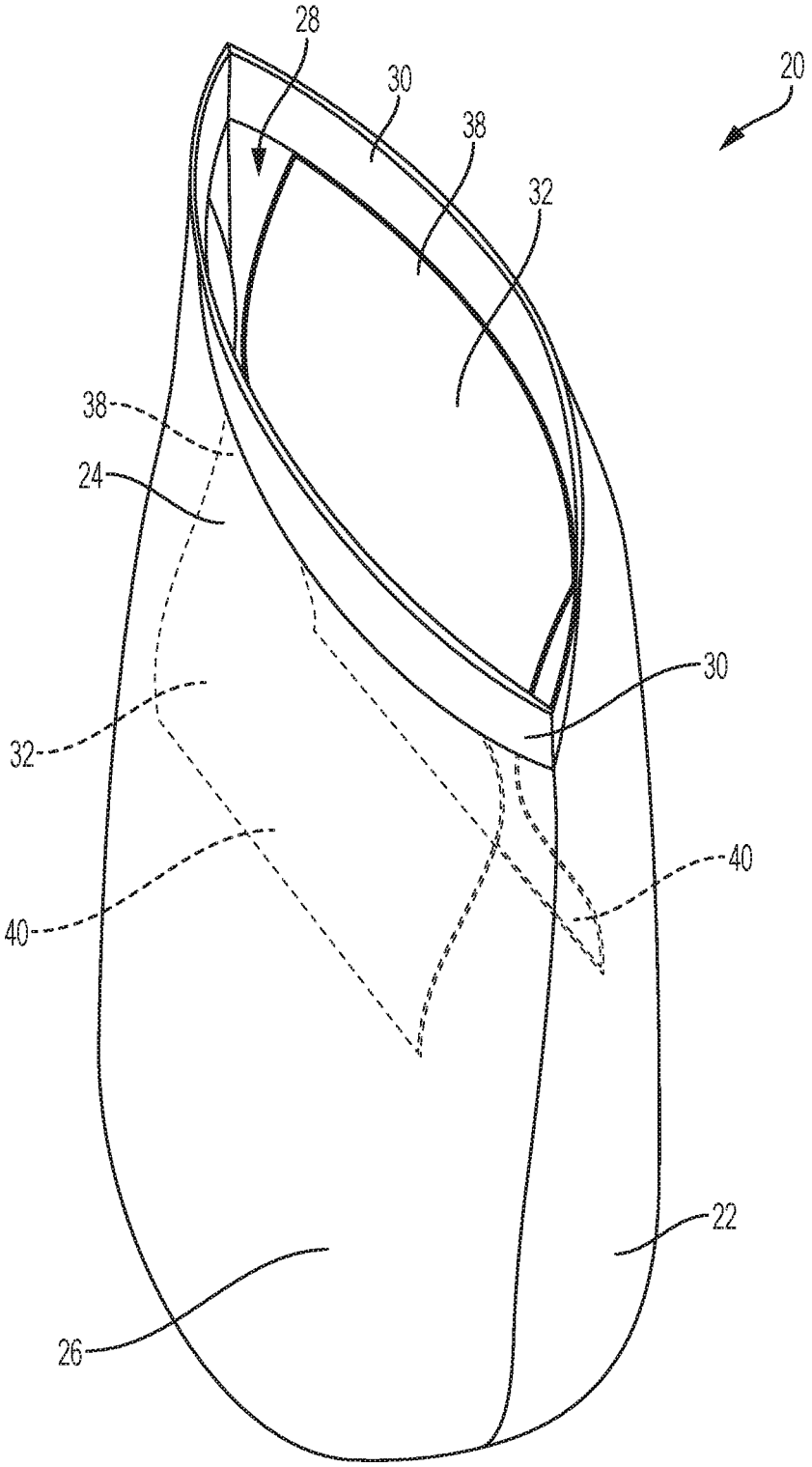
FIG. 2 is a depiction of the operation of the article of air inflatable furniture showing the sack and flaps of the article in a semi-transparent manner for purposes of conveying an understanding of the invention to others.

Reference numerals in the written specification and in the drawing figures indicate corresponding items.

DETAILED DESCRIPTION

An air support article of air inflatable furniture 20 is shown in its entirety in FIG. 1 in its inflated configuration. The particular article of air inflatable furniture 20 shown in FIG. 1 is configured to serve as a lounger for use indoors or outdoors. It should be appreciated however that the invention may pertain to other articles of air inflatable furniture, as opposed to only loungers.

Figure 6:
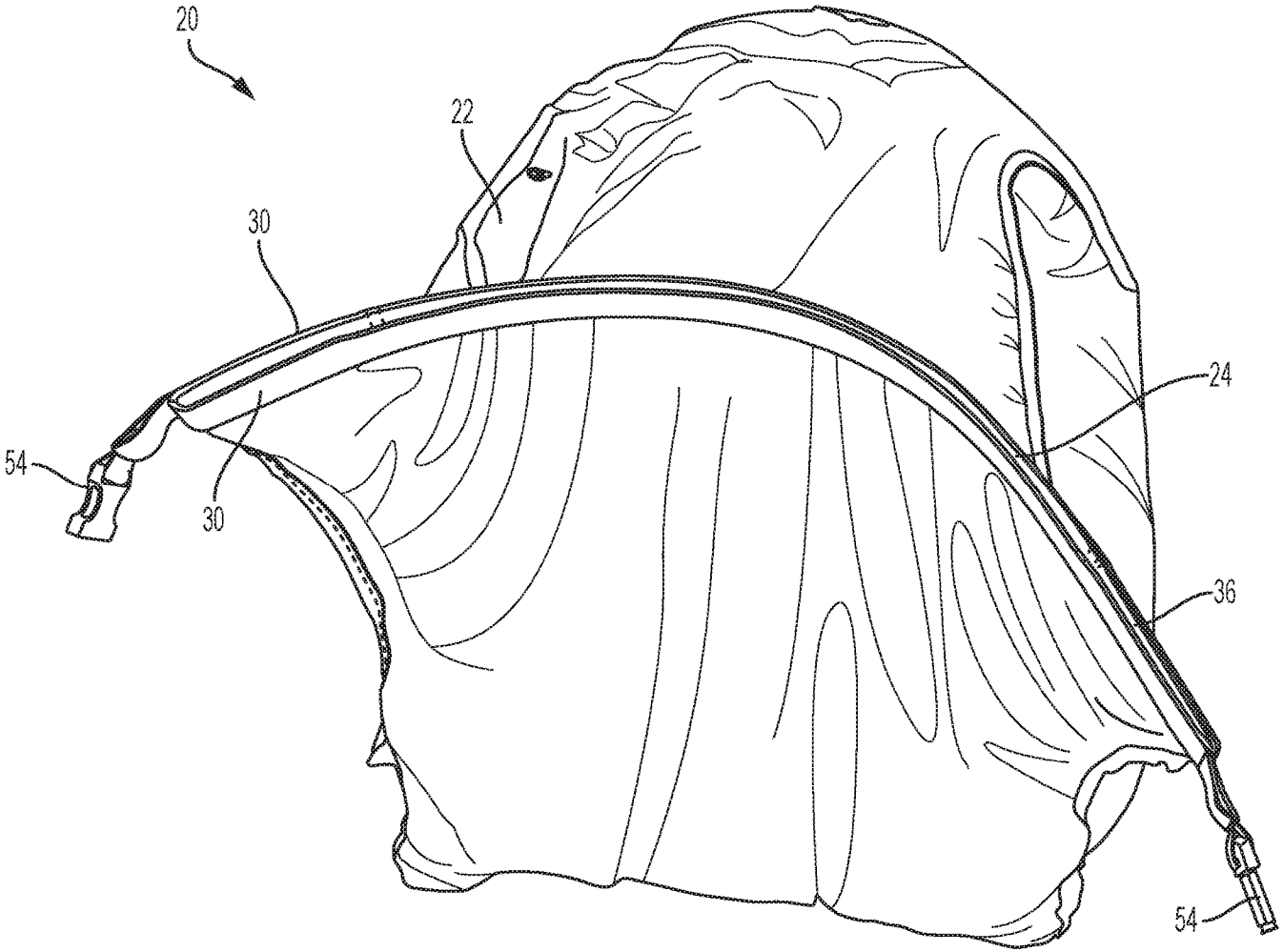
FIG. 6 depicts the article of air inflatable furniture in its deflated configuration and with the opening of the article closed.
Figure 7:
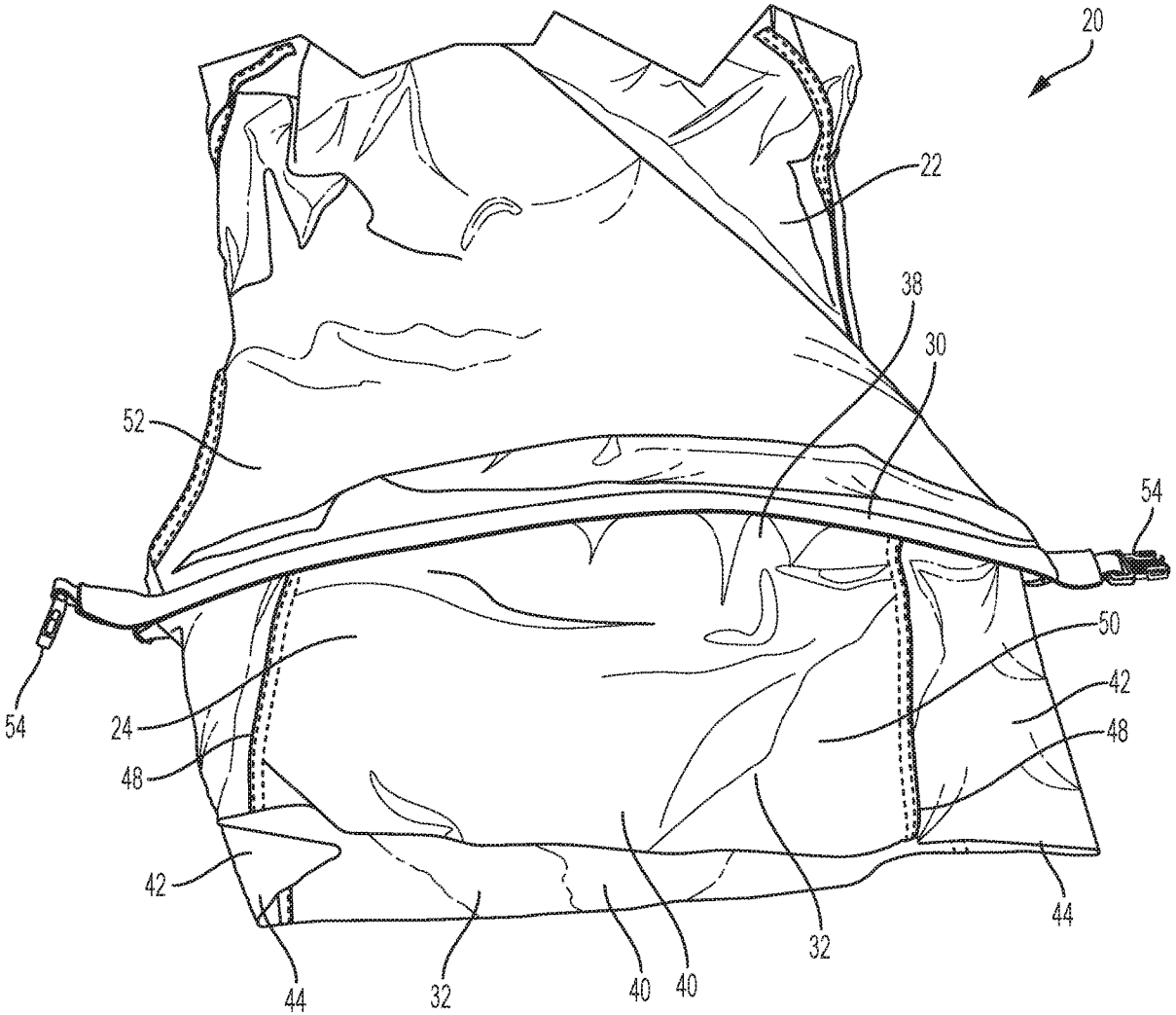
FIG. 7 depicts a portion of the article of air inflatable furniture in its deflated configuration and with the sleeve of the article extended from the outside of the sack from the opening.

The article of air inflatable furniture 20 primarily comprises a sack 22 of pliable material, such as woven fiber material or thin plastic sheet, and an inflation device 24. The sack 22 is shaped and configured to fold compactly when the article of air inflatable furniture 20 is in its deflated configuration (see FIG. 6) and to substantially enclose an air chamber 26 within an interior of the sack filled with air having a pressure greater than the surrounding air pressure for at least partially supporting a person above a surface when the article of air inflatable furniture is in its inflated configuration.

Figure 3:
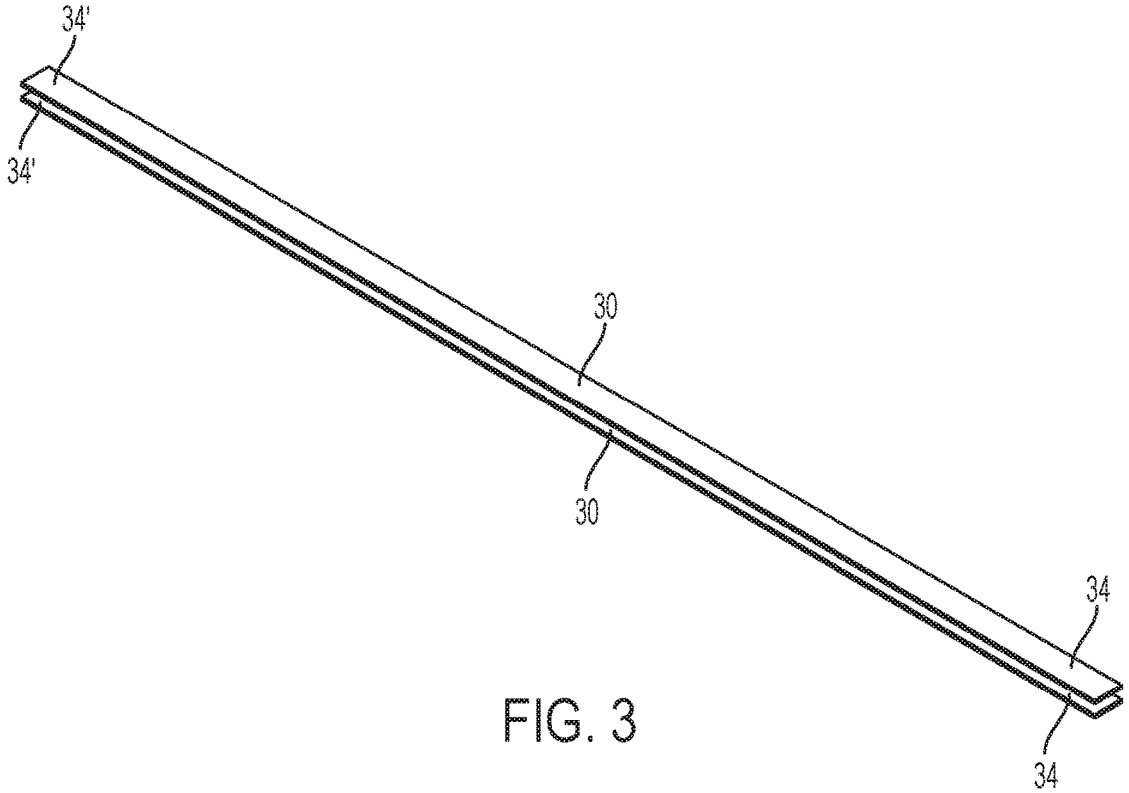
FIG. 3 depicts the resiliently flexible elongate members in their unflexed state.
Figure 4:
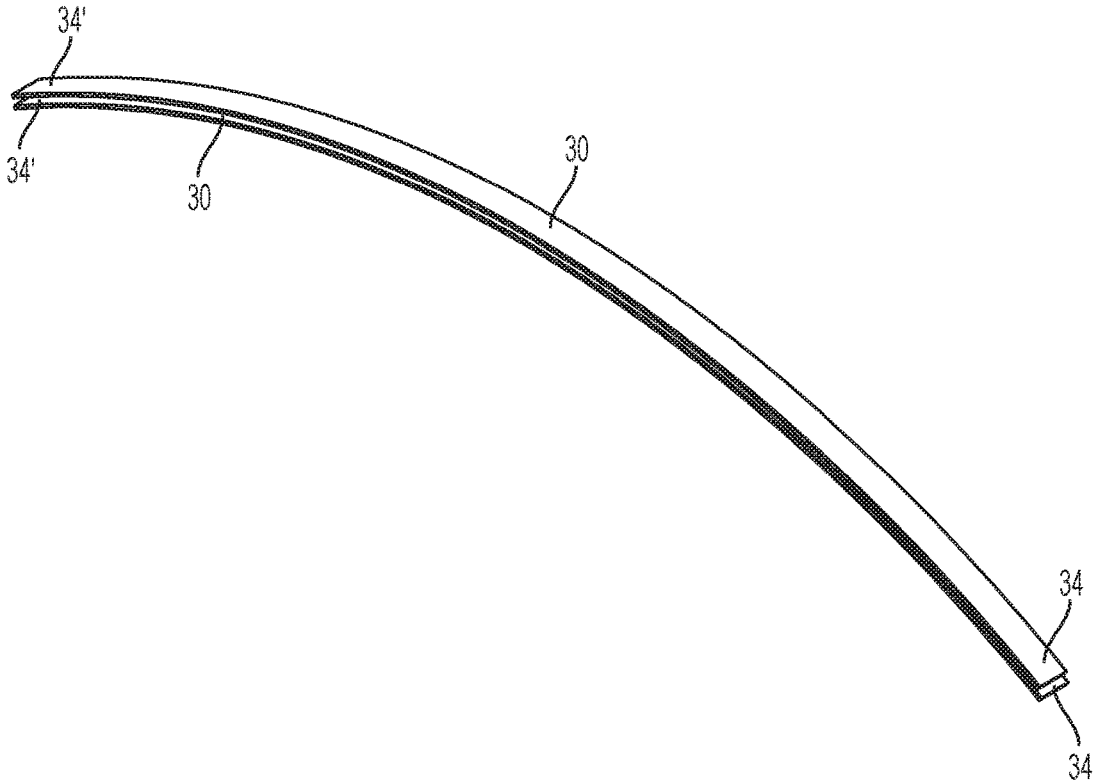
FIG. 4 depicts the resiliently flexible elongate members in their flexed position and circumjacent each other.
Figure 5:
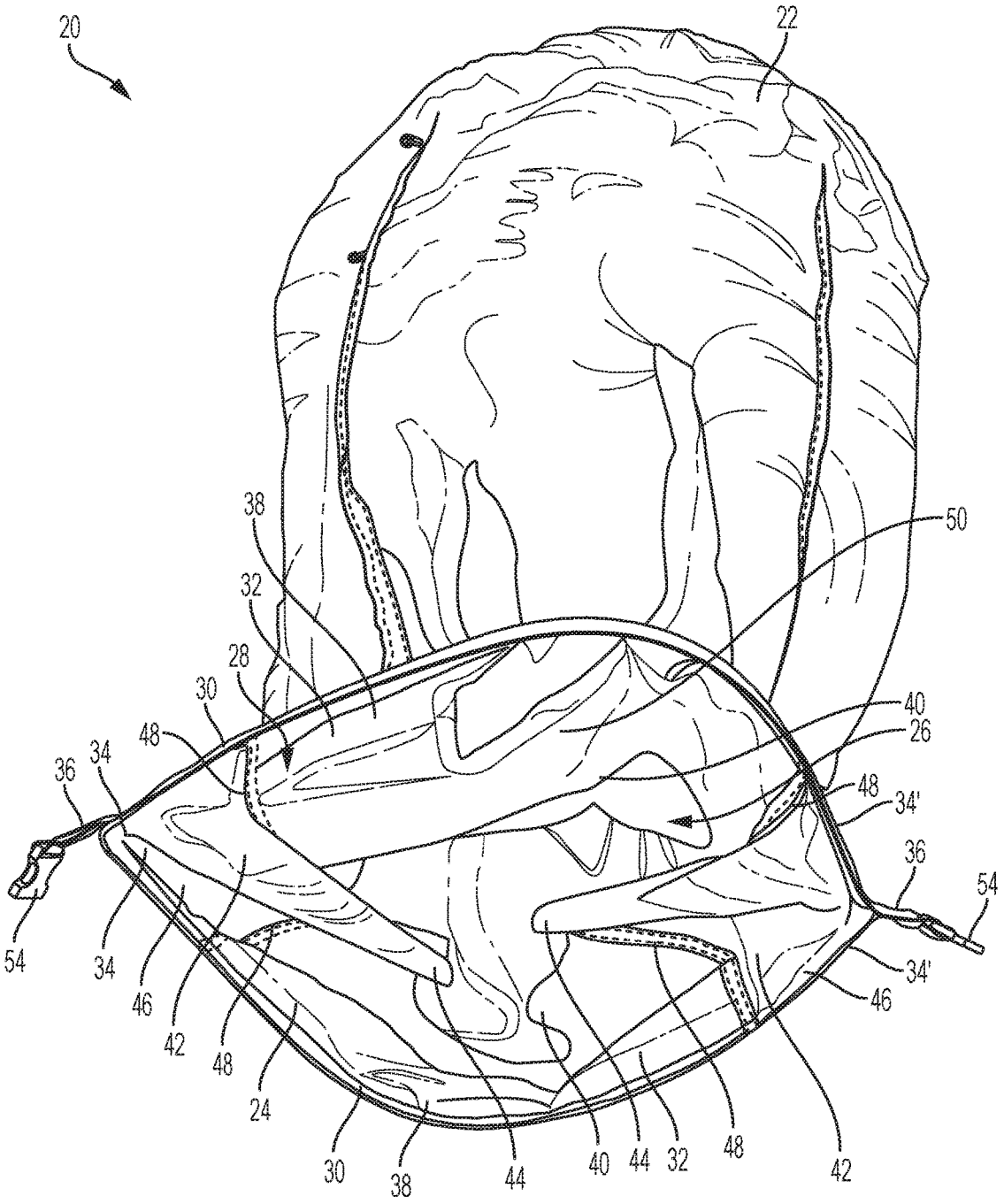
FIG. 5 depicts the article of air inflatable furniture in its deflated configuration and with the opening of the article opened.

The air inflation device 24 has an opening 28 into the air chamber 26. The opening is positionable between an open configuration and a closed configuration. The air inflation device 24 comprises first and second resiliently flexible elongate members 30 (see FIGS. 3 and 4) and at least one pliable primary flap 32. Preferably, there are two primary flaps 32 that are identical to each other. The flaps 32 are preferably coated with a polymer, and preferably the flaps are less pliable than the material that forms the majority of the sack 22. The coating also preferably makes the flaps 32 denser than the material that forms the majority of the sack 22. The elongate members 30 each have axially a first 34 and an opposite second 34' axial end. The first ends 34 of the elongate members 30 are operatively connected to each other, preferably via a woven fabric, such as woven strap webbing 36 that surrounds each of the elongate members. Likewise, the second ends 34' of the resiliently flexible elongate members 30 are operatively connected to each other, preferably via a woven fabric, such as woven strap webbing 36 that surrounds each of the elongate members. The webbing 36 or sack 22 also preferably compresses the first axial ends 34 of each elongate member 30 toward the second axial end of the elongate member (i.e., along their lengths) in a manner causing the elongate members to bow or assume a curved configuration. The resiliency of the elongate members 30 resists but does not prevent further elastic bending of the elongate members. As such, the elongate members 30 are configured and adapted such that they can be formed into curves in opposite directions from each other (for instance, to form an oval shape as shown in FIG. 5) in a manner such that the opening 28 into the sack 22 is in its open configuration, and such that they can be nested adjacent each other, either circumjacent to each other (as shown in the FIG. 6) or parallel to each other (not shown), such that the opening into the sack is in the closed configuration.

Each flap 32 has a leading edge 38 and an opposite trailing edge 40. The flaps 32 are configured to be disposed within the air chamber 26. The leading edge 38 of each flap 32 is configured to be operatively attached at least adjacent to a respective one of the elongate member 30, for instance, directly to the elongate member or via the sack 22 or webbing 36 or an intermediate structure. The opposite trailing edge 40 of each flap is preferably free to move within air chamber 26 of sack relative to the exterior of the sack.

In view of the foregoing, the air inflation device 24 is configured such that, when the opening 28 is adjusted rapidly from the closed configuration to the open configuration, the flap(s) 32 can partially prevent any air within the air chamber of the sack 22 from exiting the sack rapidly through the opening 28, since air moving out will tend to move the flap(s) toward each other or toward the nonadjacent side of the sack in a manner such that each flap acts similar to a flapper-type check valve. In contrast, if the opening 28 is adjusted from the open configuration to the closed configuration, the air between the flaps 32 or between the flap and that opposite side of the sack 22 causes the flaps to move apart from each other and/or away from opposite side of the sack 22. Thus, when the opening 28 is adjusted rapidly from the open configuration to the closed configuration air is not appreciably restricted from entering rapidly into the sack past the trailing edge(s) 38 of the flap(s). Thus, even when there is no wind to facilitate the filling of the air chamber 26, rapid opening and closing of the opening 28 will tend to inflate the sack 22.

The air inflation device 24 may also comprise pliable first and second secondary flaps 42. The first and second secondary flaps may be disposed adjacent the opening with the first secondary flap between the first and the second primary flap and the second secondary flap arranged on the opposite side of the opening between the first primary flap and the second primary flap. The first and the second secondary flaps may each have a trailing edge 44, a leading edge 46, and opposite side edges 48. A portion of the leading edge of the secondary flap may be connected to one flexible member 30, and the other portion of the leading edge of the secondary flap may be connected to the other flexible members 30. The opposite side edges 48 of the first and second secondary flaps 42 may connect to the adjacent the first and second primary flaps 32 such that the first and second primary flaps and the first and second secondary flaps collectively together form a sleeve 50 internal to the sack 22. Preferably, the first and second secondary flaps 42 are more pliable than the first and second primary flaps 32 so as not to interfere with the ability of the first and second primary flaps to move at least partially toward each other. This also helps ensure that the first and second primary flaps 32 will move toward each other when pressurized air in the sack 22 tries to escape from the sack when the opening 28 is being opened.

Figure 8:
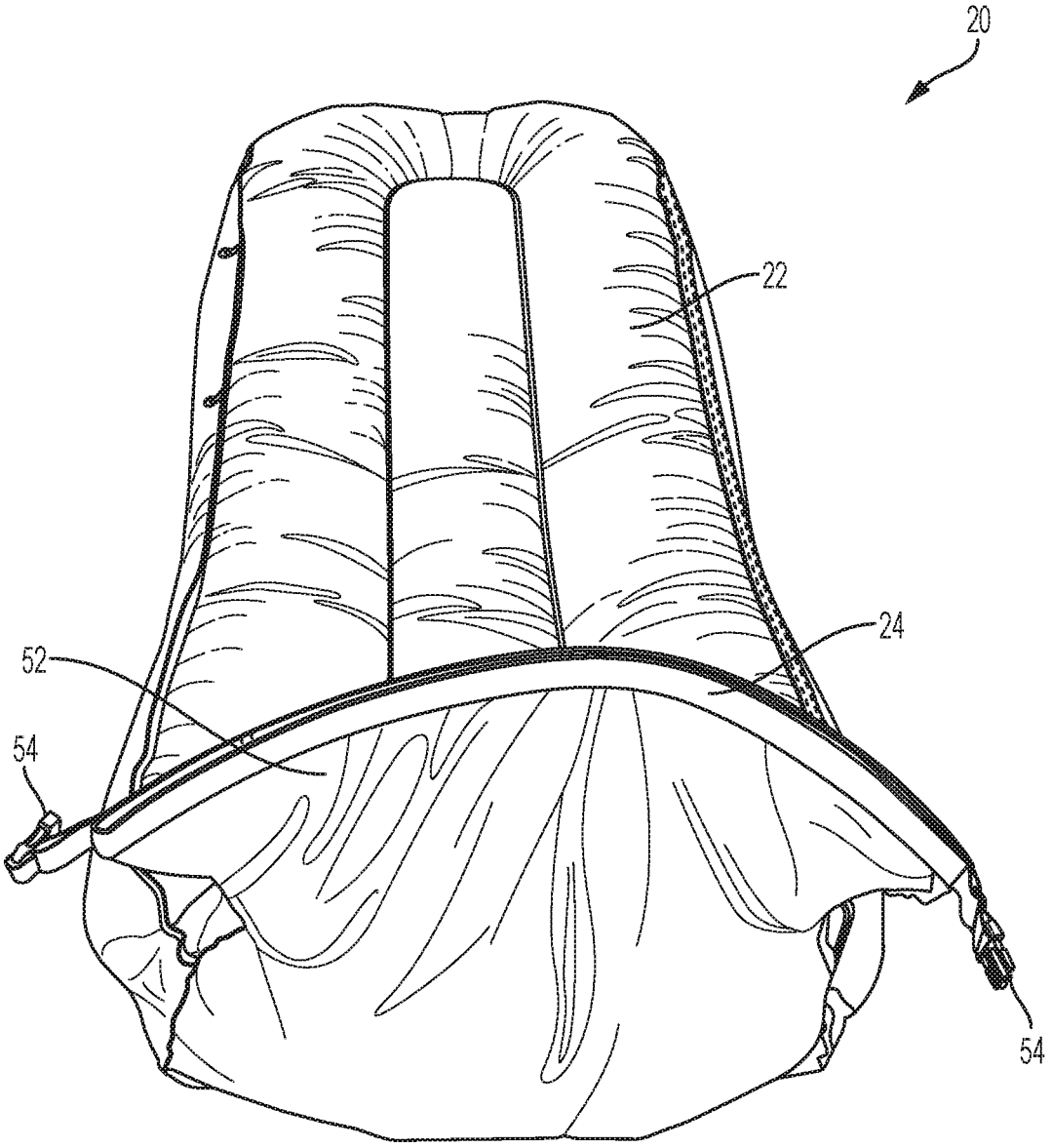
FIG. 8 shows the article inflated but prior to securing the opening in its closed-loop configuration.
Figure 9:
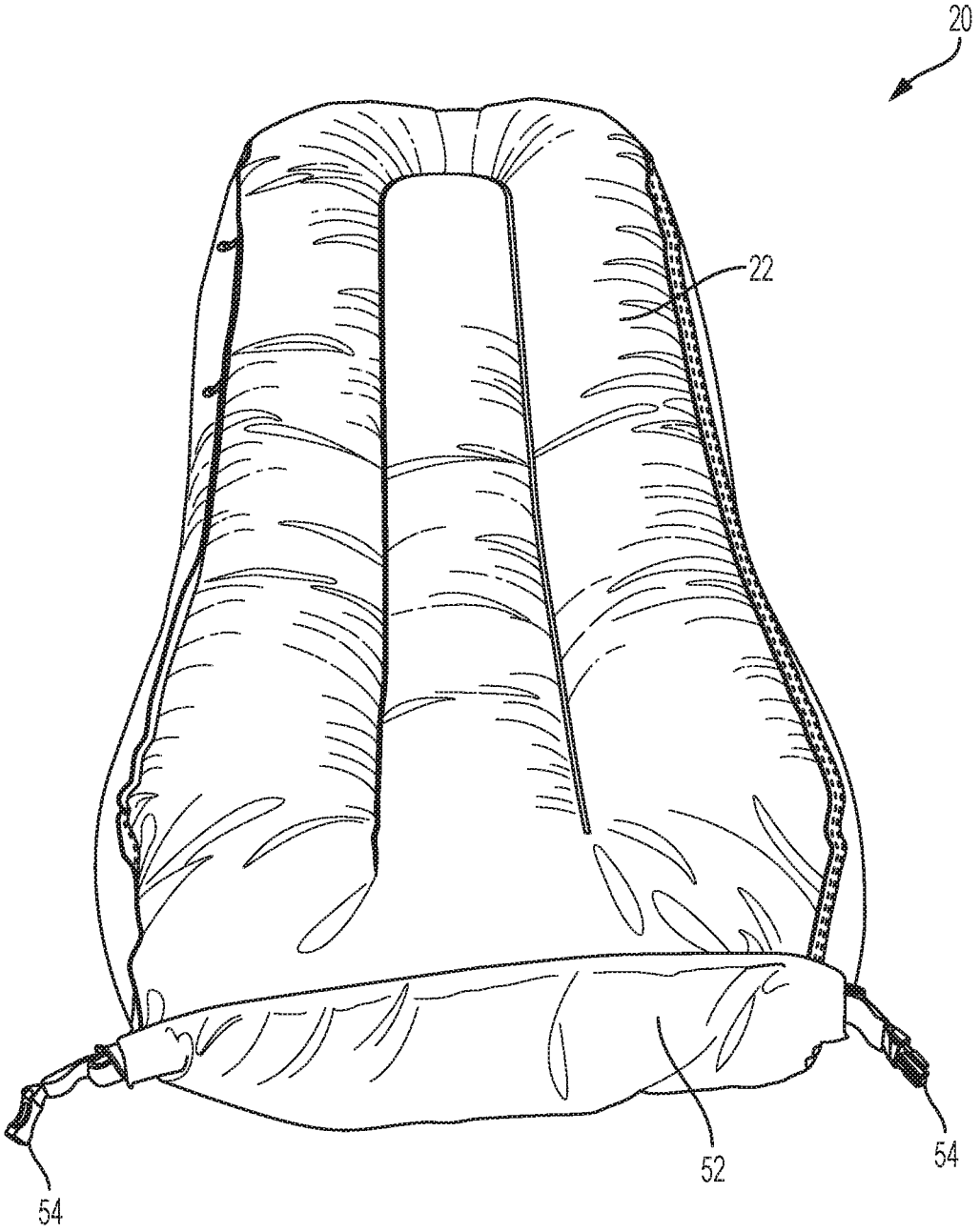
FIG. 9 shows the article inflated and with a portion of the sack wound about the elongate members of the inflation device.
Figure 10:
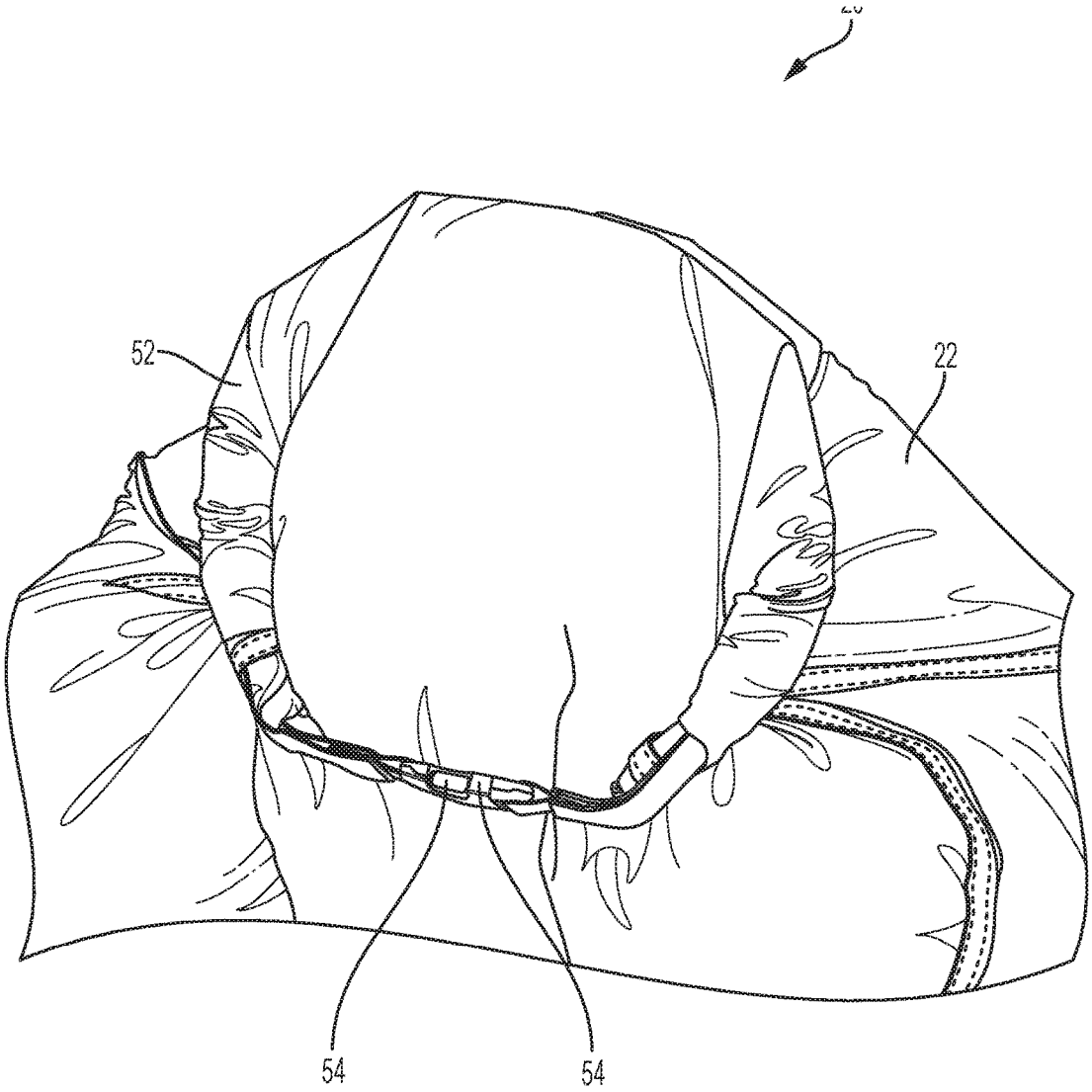
FIG. 10 shows the elongate members resiliently flexed into a loop with the ends of fittings secured to each other in a manner securing the elongate members in the looped configuration.

The sack 22 preferably includes a portion 52 adjacent to the air inflation device 24 that is configured to be wound about the elongate members 30 of the air inflation device when the sack is partially filled with air and the air inflation device is in the closed configuration. As such, once the sack 22 is substantially inflated (as shown in FIG. 8), the elongate members 30 can collectively be spun in a manner twisting the portion 52 of the sack about the elongate members (as shown in FIG. 9). This decreases the volume of the air chamber 26 and thereby increases the pressure within the air chamber and also closes the opening 28 airtight. Furthermore, the air inflation device 24 comprises a releasable connector 54 (a buckle, loop, hook and loop material, tie, snap, fastener) that allow the axial ends of the air inflation device to be releaseably connected to each other after the portion 52 of the sack 22 is wound about the elongate members 30, thereby forming the elongate members 30 into a loop (as shown in FIG. 10). Once in a loop, the portion 52 of the sack cannot be unwound from about the elongate members 30. This prevents the opening 28 from opening and completes the inflated configuration of the article of air inflatable furniture 20, thereby making the article of air inflatable furniture ready for use. After use, the article of air inflatable furniture 20 can be deflated simply by unattaching the fittings 54 from each other and allowing the portion 52 of the sack 22 to unwind from about the elongate members 30. Air will then escape from the air chamber 26, thereby deflating the article of air inflatable furniture 20 (opening the opening 28 during the deflation process will increase the rate of deflation).

In view of the foregoing, it should be appreciated that the invention has several advantages over the prior art.

As various modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

It should also be understood that when introducing elements of the present invention in the claims or in the above description of exemplary embodiments of the invention, the terms "comprising," "including," and "having" are intended to be open-ended and mean that there may be additional elements other than the listed elements. Additionally, the term "portion" should be construed as meaning some or all of the item or element that it qualifies. Moreover, use of identifiers such as first, second, and third should not be construed in a manner imposing any relative position or time sequence between limitations. Still further, the order in which the steps of any method claim that follows are presented should not be construed in a manner limiting the order in which such steps must be performed, unless such an order is inherent or explicit.

What is claimed is:

1. An air support article of air inflatable furniture comprising:

a sack being formed of a pliable material having a hollow interior, the sack being configured and adapted to be adjusted between an inflated configuration and a deflated configuration, the sack being configured to at least partially support a human above a surface when the sack is in the inflated configuration, the sack being configured to be folded compactly upon itself when in the deflated configuration; and an air inflation device, the air inflation providing an opening into the hollow interior of the sack, the air inflation device comprising first and second resiliently flexible elongate members, the resiliently flexible elongate members each having a first axial end and a second axial end, the resiliently flexible elongate member second end being opposite the resiliently flexible elongate member first end, the first ends of the resiliently flexible elongate members being operatively connected to each other, the second ends of the resiliently flexible elongate members being operatively connected to each other, the resiliently flexible elongate members being configured and adapted to be moved in opposite directions from each other in a manner to form an opening into the sack and place the opening in an open configuration, the resiliently flexible elongate members also being configured and adapted to be moved adjacent to each other to close the opening into the sack and place the opening in a closed configuration, the air inflation device having first and second primary pliable flaps, the first and second primary pliable flaps having opposite leading and trailing edges, the leading edge of the first primary pliable flap being operatively attached at least adjacent to the first resiliently flexible elongate member, the trailing edge of the first primary pliable flap being unattached to the sack and free to move within an interior of the sack, the second primary pliable flap having opposite leading and trailing edges, the leading edge of the second primary pliable flap being operatively attached at least adjacent to the second resiliently flexible elongate member, the trailing edge of the second primary pliable flap being unattached to the sack and free to move within the sack, the air inflation device being configured such that movement of the resiliently flexible elongate members from the closed configuration of the opening to the open configuration of the opening causes at least one of the first and second primary pliable flaps to move into the interior of the sack so as to (i) at least partially block the opening for preventing any air within the interior of the sack from exiting the sack through the opening, and (ii) allow air outside the sack to enter into the interior sack through the opening past the trailing edge of the respective at least one of the first and second primary pliable flaps, wherein the air inflation device further comprises pliable first and second secondary flaps, the first and second secondary pliable flaps being arranged opposite each other across the opening such that the first and second secondary pliable flaps and the first and second primary pliable flaps together form a sleeve in the interior of the sack, the first and second secondary pliable flaps being more pliable than the first and second primary pliable flaps so as not to interfere with movement of the first and second primary pliable flaps at least partially toward each other.

2. The air support article of air inflatable furniture of claim 1 wherein the first and second secondary pliable flaps are configured to limit the extent to which the first and second primary pliable flaps move away from each other when the resiliently flexible elongate members are moved from the closed configuration of the opening to the open configuration of the opening.

3. The air support article of air inflatable furniture of claim 1 wherein when the resiliently flexible elongate members are movable adjacent to each other in a closed configuration of the opening, the elongate members form a curved configuration with no external force applied to the air support article.

4. An air support article of air inflatable furniture comprising:

a sack being formed of a pliable material having a hollow interior, the sack being configured and adapted to be adjusted between an inflated configuration and a deflated configuration, the sack being configured to at least partially support a human above a surface when the sack is in the inflated configuration, the sack being configured to be folded compactly upon itself when in the deflated configuration; and an air inflation device, the air inflation providing an opening into the hollow interior of the sack, the air inflation device comprising first and second resiliently flexible elongate members, the resiliently flexible elongate members each having a first axial end and a second axial end, the resiliently flexible elongate member second end being opposite the resiliently flexible elongate member first end, the first ends of the resiliently flexible elongate members being operatively connected to each other, the second ends of the resiliently flexible elongate members being operatively connected to each other, the resiliently flexible elongate members being configured and adapted to be moved in opposite directions from each other in a manner to form an opening into the sack and place the opening in an open configuration, the resiliently flexible elongate members also being configured and adapted to be moved adjacent to each other to close the opening into the sack and place the opening in a closed configuration, the air inflation device having at least one pliable flap, the at least one pliable flap having opposite leading and trailing edges, the leading edge of the at least one pliable flap being operatively attached at least adjacent to the first resiliently flexible elongate member, the trailing edge of the at least one pliable flap being unattached to the sack and free to move within an interior of the sack, the air inflation device being configured such that movement of the resiliently flexible elongate members from the closed configuration of the opening to the open configuration of the opening causes the at least one pliable flap to move into the interior of the sack so as to (i) at least partially block the opening for preventing any air within the interior of the sack from exiting the sack through the opening, and (ii) allow air outside the sack to enter into the interior sack through the opening past the trailing edge of the at least one pliable flap;

wherein the resiliently flexible elongate members are subjected to a compressive force along their length by the sack such that the resiliently flexible elongate members form a curved configuration with no external force applied to the air support article.

5. The air support article of air inflatable furniture of claim 4 wherein the air inflation device comprises axial ends corresponding to the axial ends of the resiliently flexible elongate members and the axial ends of the air inflation device are releaseably connectable to each other in a manner such that when the opening is in the closed configuration, the air inflation device can be formed in a closed loop with the resiliently flexible elongate members adjacent to each other in the loop.

6. The air support article of air inflatable furniture of claim 5 wherein the sack includes a portion adjacent to the air inflation device that is configured to be wound about the resiliently flexible elongate members of the air inflation device when the sack is partially filled with air and the opening is in the closed configuration with the axial ends of the air inflation device unconnected to each other such that air pressure within the sack can be increased prior to releasably connecting the axial ends of the air inflation device to form the loop.

7. An air support article of air inflatable furniture comprising:

a sack being formed of a pliable material having a hollow interior, the sack being configured and adapted to be adjusted between an inflated configuration and a deflated configuration, the sack being configured to at least partially support a human above a surface when the sack is in the inflated configuration, the sack being configured to be folded compactly upon itself when in the deflated configuration; and an air inflation device providing an opening into an interior of the sack, the air inflation device comprising resiliently flexible elongate members defining the opening, each of the members having a first axial end and an opposite second axial end, the first ends of the resiliently flexible elongate members being operatively connected to each other, the second ends of the resiliently flexible elongate members being operatively connected to each other, the first and second resilient flexible elongate members being configured and adapted to be moved in opposite directions from each other in a manner to move the opening between an open configuration and a closed configuration, the air inflation device having a sleeve with a leading edge of the sleeve being operatively attached at least adjacent to the first and second resiliently flexible elongate members, the trailing edge of the sleeve being unattached to the sack and free to move within the interior of the sack, the air inflation device being configured such that movement of the resiliently flexible elongate members from the closed configuration of the opening to the open configuration of the opening causes the sleeve to move in the interior of the sack so as to (i) at least partially block the opening for preventing any air within the interior of the sack from exiting the sack through the opening, and (ii) allow air outside the sack to enter into the interior sack through the opening past the trailing edge of sleeve;

wherein the sleeve comprises first and second primary pliable flaps arranged opposite each other across the opening along a length of the resiliently flexible members, and first and second secondary pliable flaps being arranged opposite each other across the opening between the first and second primary pliable flaps.

8. The air support article of air inflatable furniture of claim 7 wherein the first and second secondary pliable flaps of the sleeve are more pliable than the first and second primary pliable flaps of the sleeve.

9. The air support article of air inflatable furniture of claim 8 wherein the first and second secondary pliable flaps of the sleeve are configured to limit the extent to which the first and second primary pliable flaps move away from each other when the resiliently flexible elongate members are moved from the closed configuration of the opening to the open configuration of the opening.

10. The air support article of air inflatable furniture of claim 7 wherein the resiliently flexible elongate members are subjected to a compressive force along their length by the sack such that the resiliently flexible elongate members form a curved configuration with no external force applied to the air support article.

11. The air support article of air inflatable furniture of claim 7 wherein when the resiliently flexible elongate members are movable adjacent to each other in a closed configuration of the opening, the elongate members form a nested curved configuration with no external force applied to the air support article.

12. The air support article of air inflatable furniture of claim 7 wherein when the resiliently flexible elongate members are movable to the open configuration of the opening, the elongate members form an oval shape with no external force applied to the air support article.

13. The air support article of air inflatable furniture of claim 7 wherein the sack includes a portion adjacent to the air inflation device that is configured to be wound about the resiliently flexible elongate members of the air inflation device when the sack is partially filled with air and the opening is in the closed configuration such that air pressure within the sack can be increased.

14. The air support article of air inflatable furniture of claim 7 wherein the air inflation device comprises axial ends corresponding to the axial ends of the resiliently flexible elongate members, and the axial ends of the air inflation device are releaseably connectable to each other in a manner such that when the opening is in the closed configuration, the air inflation device can be formed in a closed loop with the resiliently flexible elongate members nested adjacent to each other in the loop.

15. The air support article of air inflatable furniture of claim 14 wherein the air inflation device axial ends comprise a releasable connector for forming the closed loop.

* * * * *